US011142865B2

(12) United States Patent
D'oliviera Dias et al.

(10) Patent No.: US 11,142,865 B2
(45) Date of Patent: Oct. 12, 2021

(54) APPARATUS FOR STEAM TREATMENT OF LAUNDRY INCLUDING AN IRONING BOARD

(71) Applicant: SEB S.A., Ecully (FR)

(72) Inventors: Laurent D'oliviera Dias, Saint Chamond (FR); Florent Peysselon, Lyons (FR)

(73) Assignee: SEB S.A.

( * ) Notice: Subject to any disclaimer, the term of this patent is extended or adjusted under 35 U.S.C. 154(b) by 143 days.

(21) Appl. No.: 16/437,945

(22) Filed: Jun. 11, 2019

(65) Prior Publication Data

US 2019/0376228 A1 Dec. 12, 2019

(30) Foreign Application Priority Data

Jun. 12, 2018 (FR) ..... 1855138

(51) Int. Cl.
*D06F 75/06* (2006.01)
*D06F 81/02* (2006.01)

(52) U.S. Cl.
CPC ..... *D06F 75/06* (2013.01); *D06F 81/02* (2013.01)

(58) Field of Classification Search
CPC ..... D06F 75/06; D06F 75/30; D06F 75/22; D06F 79/00; D06F 79/02; D06F 79/023; D06F 81/00–12
See application file for complete search history.

(56) References Cited

U.S. PATENT DOCUMENTS 2,450,092 A 9/1948 Reichold
2,652,646 A * 9/1953 Cave, Jr. ..... D06F 81/10 38/136
3,298,325 A * 1/1967 Meath ..... D06F 81/04 108/25
6,349,490 B1 * 2/2002 Gross ..... D06F 83/00 38/137
8,033,038 B2 * 10/2011 Achterberg ..... A47B 46/00 38/104
8,266,830 B2 * 9/2012 Ma ..... D06F 81/08 38/139

(Continued)

FOREIGN PATENT DOCUMENTS

CN 102926182 A 2/2013
CN 205821843 U 12/2016
CN 206986562 U 2/2018

(Continued)

OTHER PUBLICATIONS

Search Report as issued in French Patent Application No. 1855138, dated Feb. 14, 2019.

*Primary Examiner* — Ismael Izaguirre
(74) *Attorney, Agent, or Firm* — Lerner, David, Littenberg, Krumholz & Mentlik, LLP

(57) ABSTRACT

Apparatus for steam treatment of laundry including an ironing and/or smoothing tool including at least one hole for the emission of steam and at least one pole which supports an ironing board including a bearing surface that can be arranged vertically and against which a garment to be smoothed can be arranged so that it can be steam-treated using the tool, wherein the board includes at least two identical parts put end to end and joined to one another which together at least partially define the bearing surface.

13 Claims, 3 Drawing Sheets

(56) References Cited

U.S. PATENT DOCUMENTS

| | | | | |
|---|---|---|---|---|
| 9,708,753 | B2 * | 7/2017 | Yoo | D06F 81/00 |
| 9,869,054 | B2 * | 1/2018 | Kuan | D06F 81/00 |

FOREIGN PATENT DOCUMENTS

| | | | |
|---|---|---|---|
| DE | 199 06 239 | A1 | 8/2000 |
| FR | 3 068 372 | A1 | 1/2019 |
| JP | S58-121999 | A | 7/1983 |

* cited by examiner

APPARATUS FOR STEAM TREATMENT OF LAUNDRY INCLUDING AN IRONING BOARD

CROSS REFERENCE TO RELATED APPLICATIONS

This application claims priority to French Patent Application No. 1855138, filed Jun. 12, 2018, the entire content of which is incorporated herein by reference in its entirety.

FIELD

This invention relates to an apparatus for steam treatment of laundry including an ironing and/or smoothing tool comprising at least one hole for the emission of steam and at least one pole which supports an ironing board including a bearing surface that can be arranged vertically and against which a garment to be smoothed can be arranged so that it can be steam-treated using the tool.

BACKGROUND

From the Chinese utility model CN205821843U, we know of a steam smoothing apparatus including a stand comprising two parallel poles supporting an ironing board formed by assembling two parts.

Such a steam ironing/smoothing apparatus, equipped with a rigid ironing board in two parts, has the benefit of being not very cumbersome when the two parts are separated from one another, which makes it possible to offer this apparatus in a more compact package. Such a characteristic thus reduces the costs inherent in the transport and storage of the apparatus for its sale.

However, such an apparatus has the drawback of necessitating a specific mold for the manufacture of each of the parts of the ironing board and thus of being relatively costly to manufacture.

SUMMARY

Thus, an aspect of this invention is to propose a steam ironing/smoothing apparatus equipped with an ironing board against which the garment may be supported in order to perform a vertical smoothing operation, correcting this disadvantage.

For this purpose, an aspect of the invention is an apparatus for steam treatment of laundry including an ironing and/or smoothing tool comprising at least one hole for the emission of steam and at least one pole which supports an ironing board comprising a bearing surface that can be arranged vertically and against which a garment to be smoothed can be arranged so that it can be steam-treated using the tool, wherein the ironing board includes at least two identical parts put end to end and joined to one another which together at least partially define the bearing surface.

Such a characteristic reduces the manufacturing cost of the ironing board by using the same mold to make the two parts of the ironing board.

According to another beneficial characteristic of the invention, the part of the ironing board has a rectangular general shape and includes a connecting edge at which the parts are joined to one another.

According to another beneficial characteristic of the invention, the connecting edge includes at least one protruding element and at least one cavity intended to receive the protruding element of the other part.

Such a characteristic contributes to the assembly of the two parts by having an interconnection between the protruding elements and the cavities of the two parts.

According to another beneficial characteristic of the invention, the cavity is arranged symmetrically to the protruding element in relation to the plane perpendicular to the bearing surface passing through the middle of the connecting edge.

According to another characteristic of the invention, the protruding element has the shape of a hook which engages elastically above a stop arranged in the cavity, the stop preventing the hook from becoming disengaged from the cavity.

Such connecting means allow the two parts of the ironing board to be connected reliably and rapidly.

According to another characteristic of the invention, the two parts of the ironing board are connected to one another by at least one connecting rod which beneficially extends perpendicularly to the connecting edge.

Such a characteristic reinforces the rigidity of the ironing board, in particular at the junction between the two parts.

According to another characteristic of the invention, the connecting rod extends over at least two-thirds of the length of the ironing board.

Such a characteristic reinforces the rigidity of the ironing board over a large portion of its length.

According to another characteristic of the invention, the part of the ironing board has two lateral edges which extend perpendicularly to the connecting edge and have a throat receiving the connecting rod.

Such a characteristic has the benefit of making the connecting rod almost invisible to the user, while making the ironing board very rigid.

According to another characteristic of the invention, the throat includes an element for wedging the connecting rod into the throat, beneficially formed of an elastic return element.

According to another beneficial characteristic of the invention, the connecting rod is made of metal.

According to another beneficial characteristic of the invention, the part of the ironing board is made of plastic material.

Such a characteristic makes it possible to obtain a light ironing board that is economical to manufacture, and whose shapes can be complex.

According to another beneficial characteristic of the invention, the ironing board includes a removable slipcover to cover the bearing surface.

According to another characteristic of the invention, the ironing board is mounted such that it can pivot on the pole by means of a hinge device allowing the ironing board to be immobilized in various tilted positions.

According to another beneficial characteristic of the invention, the hinge device allows the ironing board to be immobilized in at least one horizontal position, one vertical position and one intermediate position between the vertical position and the horizontal position.

Such a characteristic optimizes the apparatus' ergonomics of use by offering three positions with three very different ergonomics of use.

According to another beneficial characteristic of the invention, the pole is telescopic.

Such a characteristic allows the height of the ironing board to be adjusted.

According to another beneficial characteristic of the invention, the pole is arranged vertically.

According to another characteristic of the invention, the apparatus includes two parallel poles which support the ironing board.

According to another beneficial characteristic of the invention, the hinge device comprises two identical hinge systems at the extremity of each pole.

According to another characteristic of the invention, the apparatus includes a base containing a water reservoir, the base being connected by a conduit to the ironing and/or smoothing tool.

According to another beneficial characteristic of the invention, the base includes an electric pump allowing water to be sent from the reservoir toward the smoothing tool, the smoothing tool including an instant steaming chamber.

Such a characteristic makes it possible to have a base that is compact and very simple to make, the steam being produced directly in the steaming chamber supported by the smoothing tool.

According to another beneficial characteristic of the invention, the pole is integral with a stand that supports the base.

According to another beneficial characteristic of the invention, the base is removably mounted on the stand.

Such a characteristic permits using the base and the smoothing tool associated with it independently of the structure supporting the ironing board.

According to another beneficial characteristic of the invention, the ironing and/or smoothing tool is an iron comprising a heating soleplate equipped with steam outlet holes.

According to another beneficial characteristic of the invention, the iron includes a body comprising a gripping handle protruding on one side of the body, the gripping handle extending laterally relative to the soleplate and overhanging the latter.

BRIEF DESCRIPTION OF THE DRAWINGS

The purposes, aspects, and benefits of this invention will be more fully understood in consideration of the following description of a particular embodiment of the invention presented as a non-restrictive example, by referring to the attached drawings in which.

DETAILED DESCRIPTION

Only the elements necessary for understanding the invention have been represented. To facilitate reading of the drawings, the same elements bear the same references from one figure to the next. Note that in this document, the terms "horizontal," "vertical," "lower," "upper," "front" and "rear" used to describe the apparatus refer to this apparatus when it is resting flat on its stand as illustrated in FIG. 1.

Figure 1:
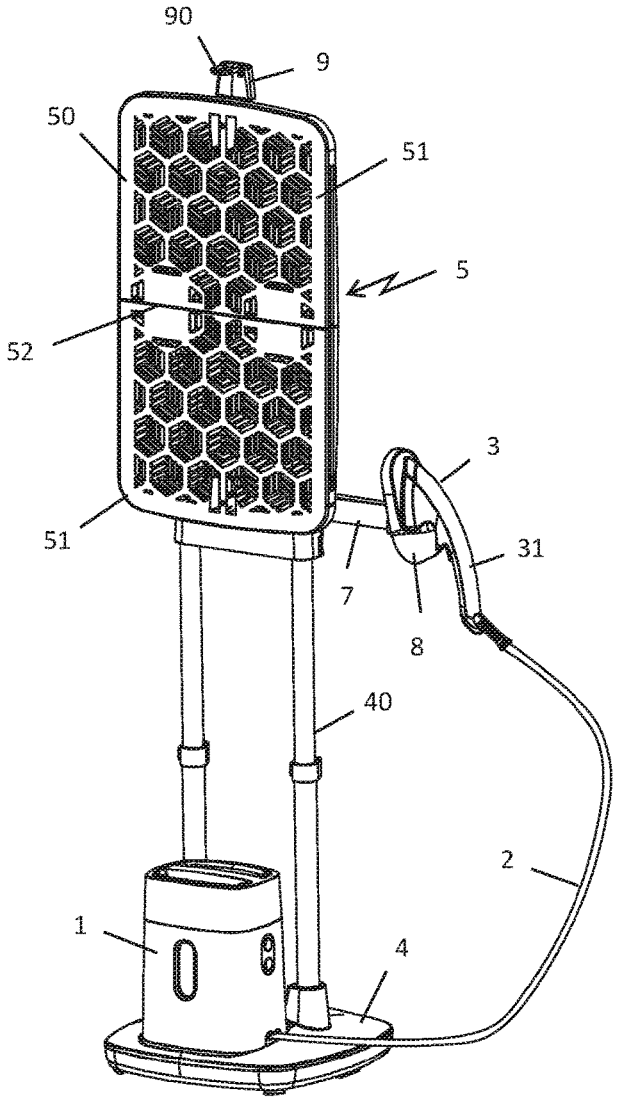
FIGS. 1 and 2 are perspective views of an ironing apparatus according to a particular embodiment of the invention with the ironing board in a vertical position.
Figure 2:
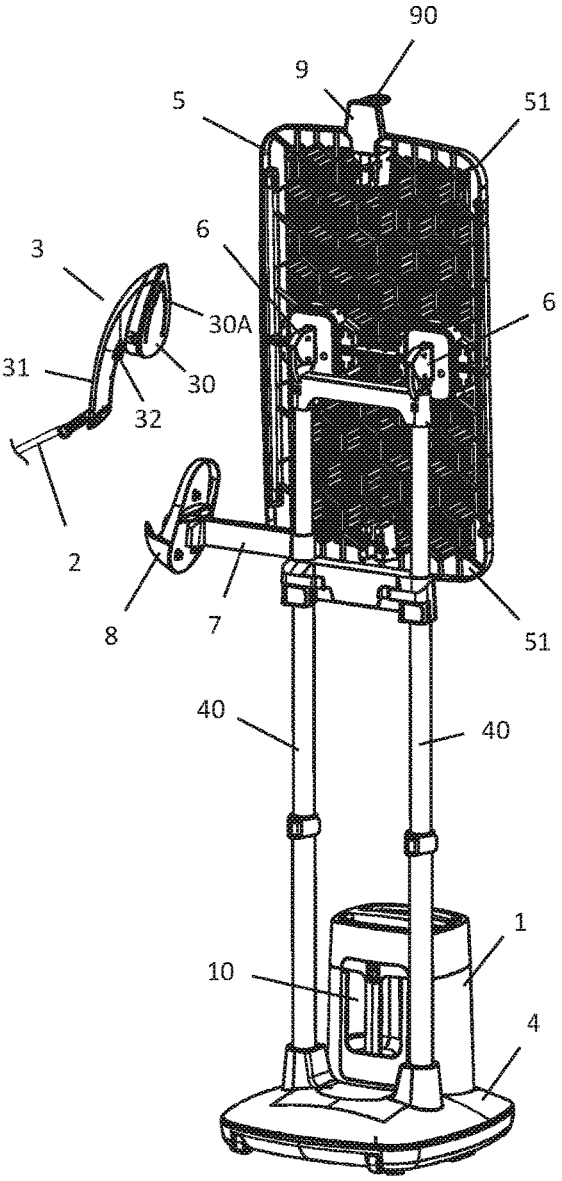
Figure 3:
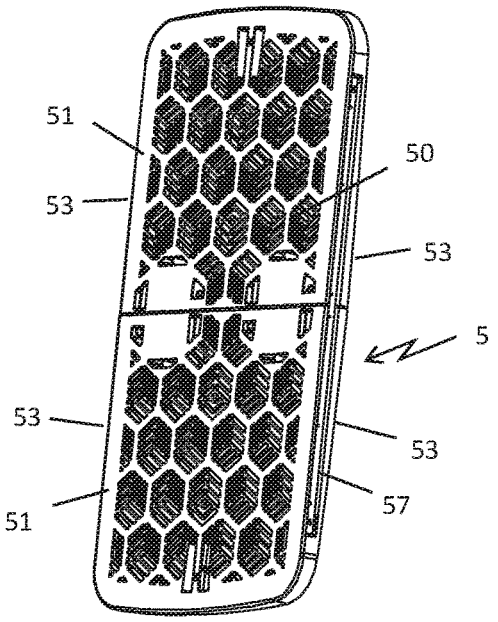
FIG. 3 is a perspective view of the front face of the ironing board represented in isolation and not equipped with connecting rods.

FIGS. 1 and 2 represent a steam ironing apparatus including a portable base 1 connected by a flexible conduit 2 to a steam iron 3, the base 1 being electrically connected to a household network by a cable, not visible in the figures.

The base 1 comprises a removable reservoir 10 and a pump which draws water from the reservoir 10 to send it to the iron 3 through a pipe integrated in the conduit.

The iron 3 comprises, in a manner known per se, a flat soleplate 30 surmounted by a body which comprises a gripping handle 31 including a free rear extremity protruding laterally relative to the body. The body contains, in a manner known per se, a casting which is in thermal contact with the soleplate and comprises a heating resistor, controlled by means of a non-adjustable thermostat, allowing the temperature of the soleplate 30 to be maintained around a setpoint temperature of approximately 135° C. (e.g. +/−5° C.).

The casting is beneficially made of aluminum and it includes an instant steaming chamber into which the water coming from the reservoir 10 is injected by the pump, the operation of the pump being controlled by a trigger 32 provided under the front extremity of the gripping handle 31. The pump and the steaming chamber are beneficially sized to allow the production of a continuous steam flow of approximately 25 g/min (e.g. +/−1 g/min) when the trigger 32 is actuated, the soleplate 30 traditionally comprising holes 30A for the emission of steam.

The apparatus also includes a stand 4 on which the base 1 rests removably, the stand 4 including two telescopic poles 40 comprising an upper extremity supporting a rigid ironing board 5 comprising a bearing surface 50, for example flat, intended to be covered with a slipcover, not represented in the figures, and constituting an ironing surface on which laundry to be smoothed can be placed.

One of the telescopic poles 40 beneficially supports a cross arm 7 at the extremity of which an iron resting device 8 is arranged, on which the iron 3 can be placed during inactive ironing/smoothing phases.

The ironing board 5 is mounted such that it can pivot on the extremity of the poles 40 by means of a hinge device 6 allowing the ironing board 5 to be immobilized in different tilted positions and beneficially in a vertical position (illustrated in FIGS. 1 and 2), in a horizontal position, and in an intermediate position in which the ironing board 5 beneficially forms an angle of approximately 40° (e.g.)+/−5° with respect to the vertical.

This hinge device 6 is, for example, conforming to the one described in greater detail in the patent application filed in France by the applicant under the filing number FR 1756063.

In accordance with FIGS. 3 to 6, the bearing surface 50 of the ironing board 5 is formed by assembling two strictly identical parts 51 placed end to end and joined to one another with connecting means, the ironing board 5 beneficially having a substantially rectangular shape with rounded corners.

Each part 51 is in the form of a substantially rectangular plate and comprises a connecting edge 52, beneficially straight, intended to be arranged edge to edge with the connecting edge 52 of the other part 51, the part 51 having lateral edges 53 perpendicular to the connecting edge 52.

Beneficially, the part 51 has a width at the connecting edge of approximately 39 cm (e.g. +/−1 cm) and a height of approximately 34 cm (e.g. +/−1 cm), such that the ironing board 5 formed by assembling these two parts 51 has a width of approximately 39 cm (e.g. +/−1 cm) for a total height of approximately 68 cm (e.g. +/−1 cm) at its lateral edges 53.

The part 51 of the ironing board 5 is beneficially made of plastic material and has a flat front face, defining the bearing surface 50, with multiple through openings. These through openings reduce the quantity of material necessary to form the part 51, while allowing the ironing board 5 to be steam-permeable and to be lighter.

Figure 6:
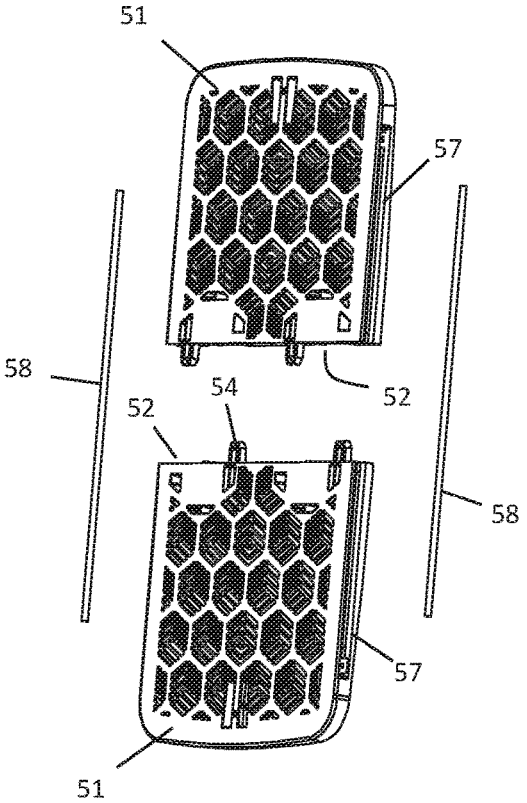
FIG. 6 is an exploded perspective view of the ironing board.
Figure 7:
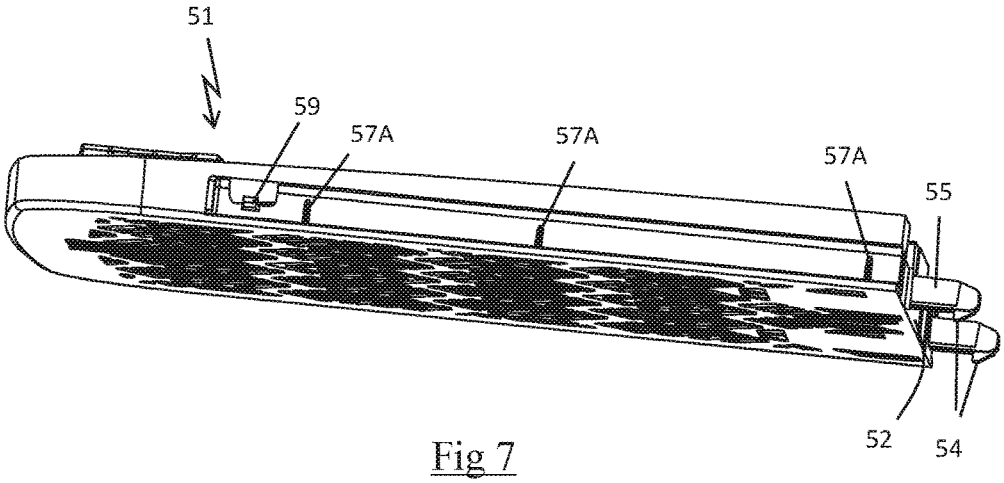
FIG. 7 is a perspective view of one part of the ironing board.
Figure 8:
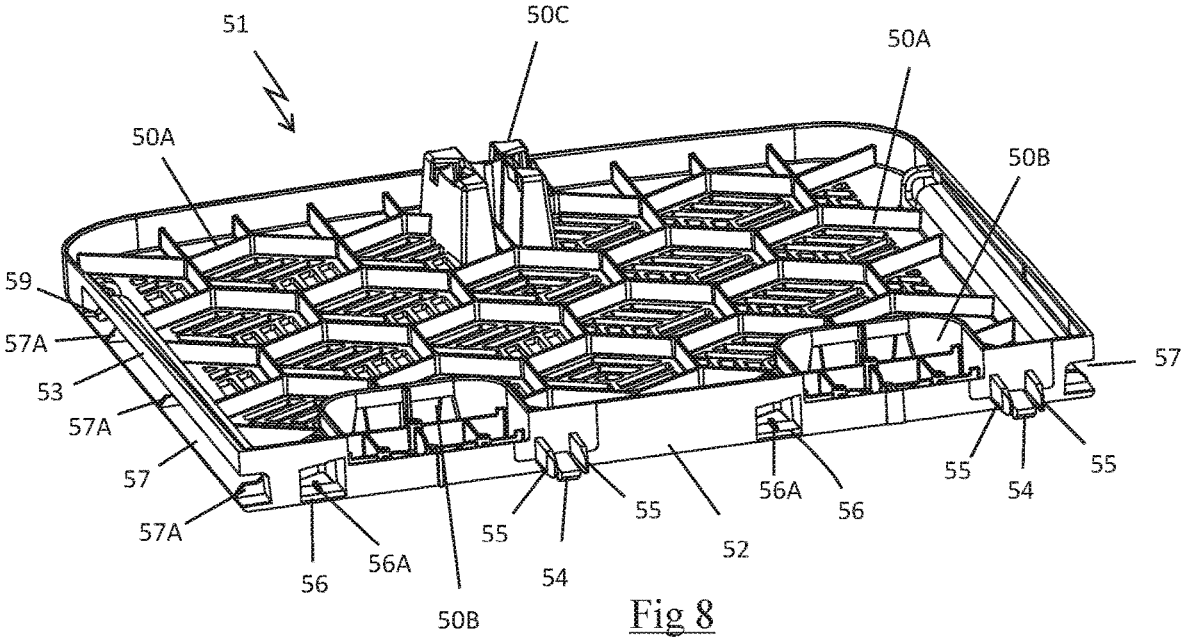
FIG. 8 is another perspective view of the part of the ironing board.

As can be seen on FIGS. 6 to 8, the connecting edge 52 beneficially includes two hooks 54 which protrude according to the longitudinal direction of the ironing board 5, each of these hooks 54 being bordered by two lateral guide walls 55, visible on FIG. 8, comprising a beveled extremity.

The connecting edge 52 also includes two cavities 56 intended to receive at the same time the lateral guide walls 55 and the hooks 54 when the connecting edges 52 of each of the parts 51 are brought against one another.

For this purpose, the cavities 56 are arranged symmetrically to the hooks 54 in relation to the median plane which passes through the middle of the connecting edge 52 and which is perpendicular to the bearing surface 50, such that the cavities 56 are found opposite the hooks 54 when the connecting edges 52 of the two parts 51 are brought against one another with their front face arranged on the same side.

Each cavity 56 beneficially comprises a protruding stop 56A behind which the hook 54 engages elastically when the connecting edges 52 are arranged edge to edge, such an insertion of the hooks 54 behind the stops 56A making it possible to immobilize the two parts against one another and to prevent them from moving apart from one another.

In an embodiment, the hooks 54 and the cavities 56 are distributed evenly on the connecting edge 52 so as to obtain four anchor points distributed evenly on the width of the ironing board 5.

Figure 4:
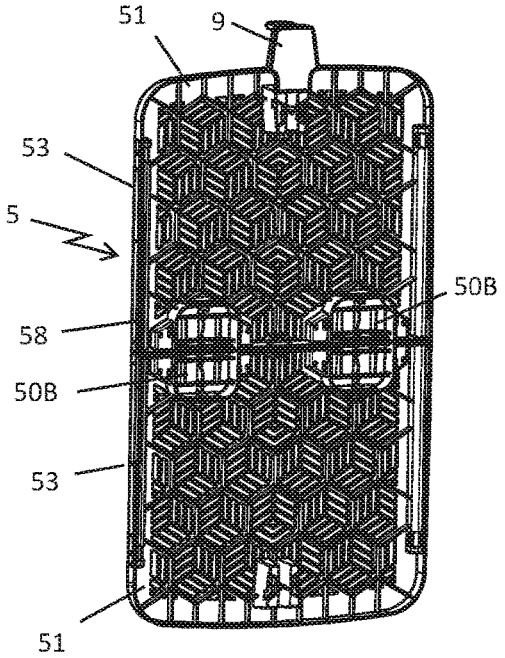
FIG. 4 is a perspective view of the rear face of the ironing board in FIG. 3, equipped with the hanger support and connecting rods.
Figure 5:
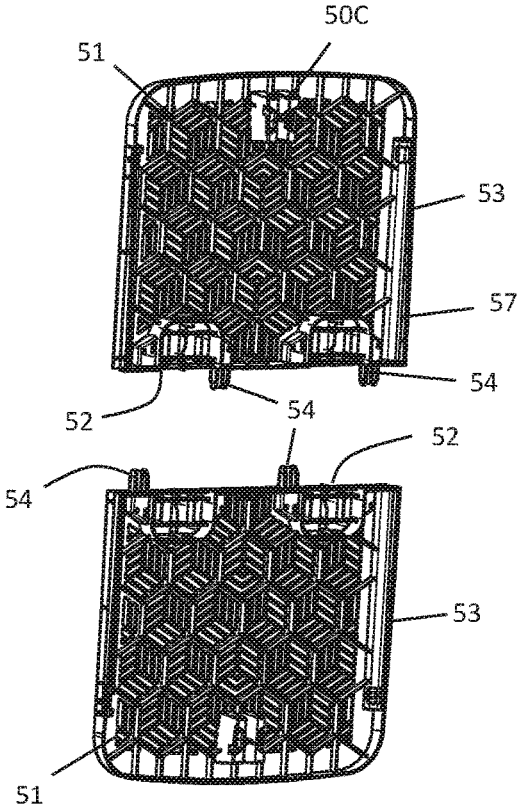
FIG. 5 is a perspective view of the rear face of the two parts of the ironing board prior to their assembly.

In accordance with FIGS. 4, 6 and 7, the part 51 of the ironing board 5 comprises a throat 57, arranged at each lateral edge 53, in which is inserted a connecting rod 58 which connects the two parts 51 of the ironing board 5 and reinforces the bending strength of the ironing board 5, in particular at the junction between the two connecting edges 52.

The throat 57 extends from the connecting edge 52 on more than 70% of the length of the lateral edge 53 and includes an extremity equipped with an immobilizing hook 59 behind which the connecting rod 58 is wedged when it is press fit into the throat 57, the latter beneficially comprising several guide lugs 57A distributed along the throat 57 to immobilize the connecting rod 58 in the throat 57.

For example, the two connecting rods 58 equipping the ironing board 5 may be made with metal tubes having a diameter of approximately 8 mm (e.g. +1-1 mm) and a length of approximately 53 cm (e.g. +/−1 cm).

In accordance with FIG. 8, the rear face of the part 51 has multiple reinforcing ribs 50A beneficially arranged according to a hexagonal grid, reinforcing the rigidity of the ironing board 5.

The rear face also includes, at the edge of the connecting edge 52, two reception housings 50B at which is attached the hinge device 6 connecting the ironing board 5 to the poles 40 and includes a fastening stud 50C arranged on the median plane of the ironing board 5, close to the edge opposite the connecting edge 52.

As can be seen on FIGS. 1, 2 and 4, the fastening stud 50C of the part 51 defining the upper half of the ironing board 5 is beneficially equipped with a support 9 protruding on the upper extremity of the ironing board 5, this support 9 comprising a ring 90 on which a hanger can be hung.

The apparatus thus realized has the benefit of having great ergonomics of use while being very economical to manufacture.

In fact, using two identical parts 51 to form the ironing board 5 reduces manufacturing costs since it necessitates only one manufacturing mold.

In addition, the fact that the ironing board 5 is in two parts makes the apparatus more compact when it is in its carton for sale, which reduces transport costs.

When the user unpacks the apparatus for the first time, he can assemble the two parts 51 of the ironing board 5 very easily by bringing the connecting edges 52 of the two parts 51 against one another such that the hooks 54 are inserted into the cavities 56, this docking of the two connecting edges 52 being facilitated by the presence of two lateral guide walls 55 which frame the hooks 54.

Once the two parts 51 are joined to one another by the hooks 54, the user has only to insert the two connecting rods 58 into the throats 57 in order to make the ironing board particularly rigid.

Then he has only to attach the hinge device 6 to the ironing board 5 to obtain a fully functional apparatus with very good ergonomics of use.

It will be appreciated that the invention is in no way limited to the embodiment described and illustrated, which has been provided only as an example. Modifications are still possible, in particular from the point of view of the composition of the various components or by substitution of equivalent techniques, without departing from the scope of protection of the invention.

Thus, in one embodiment variant not represented, the ironing board may not have a connecting rod and may be fixed, for example, directly to the poles without the possibility of tipping the ironing board.

Thus, in one embodiment variant not represented, the ironing board may comprise one or more connecting rods arranged in throats arranged on the front face or on the rear face of the ironing board rather than on the lateral edges.

Thus, in one embodiment variant not represented, the connecting rod may be made of plastic material.

Thus, in one embodiment variant not represented, the ironing board may be supported by a single pole.

Thus, in another embodiment not represented, the base may generate steam and be connected by a conduit to a steam-emitting smoothing brush.

The invention claimed is:

1. An apparatus for steam treatment of laundry including an ironing and/or smoothing tool comprising at least one hole for the emission of steam and at least one pole which supports an ironing board comprising a bearing surface that can be arranged vertically and against which a garment to be smoothed can be arranged so that the garment can be steam-treated using the tool, wherein the board includes at least two identical parts put end to end and joined to one another which together at least partially define the bearing surface.

2. The apparatus according to claim 1, wherein each of said at least two parts of the board has a rectangular general shape and includes a connecting edge at which the at least two parts are joined to one another.

3. The apparatus according to claim 2, wherein the connecting edge includes at least one protruding element and at least one cavity intended to receive the protruding element of the other part.

4. The apparatus according to claim 3, wherein the protruding element has the shape of a hook which engages elastically above a stop arranged in the cavity, the stop preventing the hook from becoming disengaged from the cavity.

5. The apparatus according to claim 2, wherein the at least two parts of the board are connected to one another by at least a connecting rod.

6. The apparatus according to claim 5, wherein the connecting rod extends over at least two-thirds of the length of the ironing board.

7. The apparatus according to claim 5, wherein each the least two parts of the ironing board has two lateral edges which extend perpendicularly to the connecting edge and have a throat receiving the connecting rod.

8. The apparatus according to claim 7, wherein the throat includes an element for wedging the connecting rod into the throat.

9. The apparatus according to claim 5, wherein the connecting rod is made of metal.

10. The apparatus according to claim 1, wherein each of the at least two parts of the ironing board is made of plastic material.

11. The apparatus according to claim 1, wherein the ironing board is mounted such that the ironing board is pivotable on the pole by a hinge device allowing the ironing board to be immobilized in various tilted positions.

12. The apparatus according to claim 1, comprising two parallel poles which support the ironing board.

13. The apparatus according to claim 1, comprising a base containing a water reservoir, the base being connected by a conduit to the ironing and/or smoothing tool.

* * * * *